United States Patent [19]

Baird

[11] 4,428,390

[45] Jan. 31, 1984

[54] CARRYING DEVICE FOR CRUTCHES

[76] Inventor: Joseph L. Baird, 336 Park Ave., Kent, Ohio 44240

[21] Appl. No.: 338,588

[22] Filed: Jan. 11, 1982

[51] Int. Cl.[3] ..... A61H 3/02

[52] U.S. Cl. ..... 135/66; 135/68

[58] Field of Search ..... 135/66, 68; 24/135 R; 150/34, 37, 40, 42

[56] References Cited

U.S. PATENT DOCUMENTS

| | | | |
|---|---|---|---|
| 1,139,370 | 5/1915 | Putnam | 150/40 |
| 2,311,049 | 2/1943 | Hedden | 135/68 |
| 4,027,687 | 6/1977 | McGowan | 135/66 |
| 4,097,169 | 6/1978 | Kelly | 24/135 R X |
| 4,289,156 | 9/1981 | Ulics | 135/66 |
| 4,295,483 | 10/1981 | Smith | 135/66 |

*Primary Examiner*—William H. Grieb

*Attorney, Agent, or Firm*—Porter & Associates Co.

[57] ABSTRACT

A device for attachment to a crutch enables bulky objects or numerous items to be carried with little difficulty. The device includes an elongate, cylindrical tube having stoppers at each end within which a keyholder and an object carrier such as a net or a rope can be carried. The tube is attached to a crutch, preferably a single-shaft aluminum crutch, by means of a clamp. The clamp avoids the need for modification of the crutch and enables the device to be attached to crutches of any cross-sectional configuration. The device also includes a flexible casing which may be fitted in place about the crutch and the tube. The casing is equipped with various pockets for receiving items such as address books, checkbooks, and the like.

1 Claim, 6 Drawing Figures

CARRYING DEVICE FOR CRUTCHES

BACKGROUND OF THE INVENTION

1. Field of the Invention

The invention relates to devices for attachment to crutches, and, more particularly, to a lightweight, compact device which will enable the user of the crutches to carry a variety of objects.

2. Description of the Prior Art

One of the most difficult problems that a user of crutches faces is carrying bulky objects or a number of small objects at the same time. Since a person who walks with crutches obviously does not have perfect freedom in the use of the hands, it is necessary to make use of satchels, bags, paper sacks, or some type of carrying device that is easily graspable by the hands which, at the same time, are engaged with the hand grips of the crutches. It is clear that a person walking with crutches cannot, under ordinary circumstances, always carry what is desired to be carried, or cannot carry items and walk with desired speed or skill.

Others have recognized the difficulty of walking with crutches and carrying objects at the same time, and various devices have been provided to assist a user of crutches in carrying objects. Unfortunately, the prior devices have suffered from certain drawbacks. A typical drawback is the requirement that the carrying device be attached to the crutch by drilling holes in the crutch or otherwise modifying the configuration of the crutch. Other devices are usable only with certain kinds of crutches. For example, one known device is suitable for use with a conventional crutch construction employing parallel side rails, but an important drawback of this device is that the side rails must be of a particular size and must be spaced a predetermined distance.

Another problem of prior crutch attachment devices is that relatively few objects can be carried. Also, it is difficult or impossible to carry bulky objects or heavy objects. In part, this is because prior crutch attachment devices have been attached to the crutches at a location below the handgrips. Weight applied to the crutches at a location below the handgrips causes instability which greatly increases the difficulty of walking with the crutches.

In view of the foregoing difficulties of prior art devices, it is an object of the invention to provide a carrying device for attachment to crutches in which modification of the crutches is not necessary, whether by drilling holes in the crutches or otherwise.

It is a further object of the invention to provide a carrying device for attachment to crutches, which device can be usable with crutches of virtually any configuration.

It is yet an additional object of the invention to provide a carrying device for attachment to crutches, which device will enable the user of the crutches to carry large objects, heavy objects, or a large number of small objects.

It is yet a further object of the invention to provide a carrying device for attachment to crutches, which device will enable the user of the crutches to have readily available at all times such items as keys, checkbooks, credit cards, and the like, by virtue of their being carried with the crutches themselves.

SUMMARY OF THE INVENTION

The present invention overcomes the foregoing difficulties of prior art devices and accomplishes the foregoing objectives by providing a carrying device for attachment to crutches which may be secured to a crutch member by means of a clamp. The clamp avoids the need for modification of the crutch. The clamp can be used for crutches of any cross-sectional configuration and spacing of components.

In a preferred embodiment, the device according to the invention includes an elongate, cylindrical tube having stoppers at each end. The tube is secured to a crutch by means of spaced clamps at a location above that of the crutch handgrips. The clamps completely encircle the tube and the portion of the crutch to which the tube is to be attached. Upon tightening fastening members, the clamps securely space the tube a small distance from the crutch.

One of the stoppers for the cylindrical tube includes a key ring. Upon attaching keys to the key ring, the keys can be inserted within the tube and secured within the tube by pressing the stopper into the end of the tube. In addition, the tube may contain either a rope or a cargo net having a drawstring. Assuming that two crutches are employed, each of the crutches can be provided with a carrying device according to the invention; one of the tubes thus can contain a rope and the other of the tubes can contain a net.

The invention also includes a flexible casing which may be fitted in place about the crutch and the tube. The casing is a single, rectangular piece of flexible material having interlocking fastening members at opposite ends. The casing is equipped with various pockets for receiving such items as an address book, a checkbook holder, a tube of lipstick, a pencil, and various items. A wallet-like compartment can be attached to the outside of the casing and can be used to carry such things as credit cards, as extra notebook, and the like.

By using a carrying device according to the invention, crutches of various configurations, although particularly a single-shaft aluminum crutch, can be provided with a device for carrying bulky objects or a number of small objects. The device is lightweight, compact, and very strong. It can be attached to virtually any type of crutch with minimal difficulty.

The foregoing features and advantages of the invention, together with a more complete description of the invention, may be had by referring to the following drawings and specification, together with the appended claims.

DESCRIPTION OF THE PREFERRED EMBODIMENT

Figure 2:
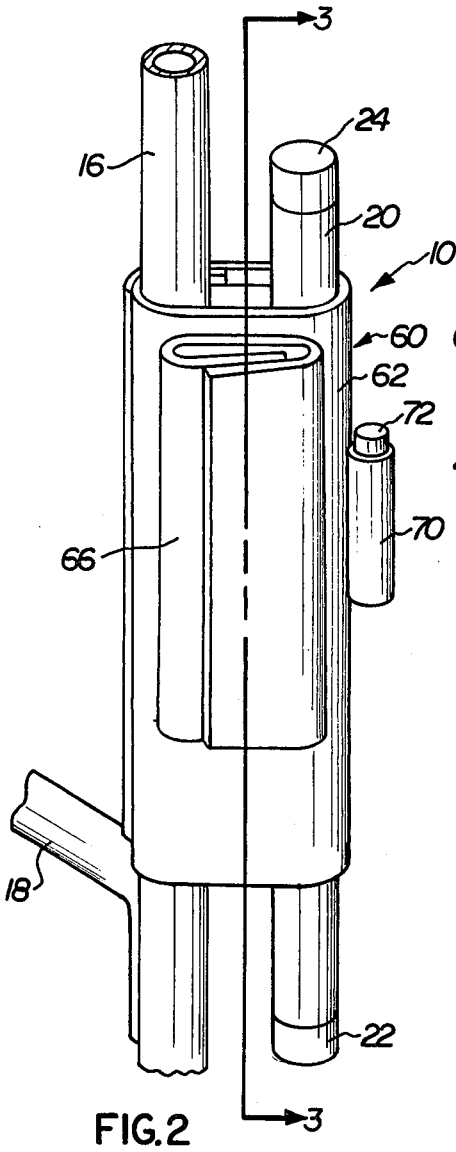
FIG. 2 is an enlarged, perspective view of a portion of the crutch of FIG. 1 showing additional details of construction.

Referring to the FIGURES, a carrying device for crutches is indicated generally by the reference numeral 10. Although the invention is particularly effective with single-shaft aluminum crutches such as that shown in FIG. 1, it will be understood that the device 10 can be attached to any of a wide variety of different crutches, and its use with a crutch employing a generally vertical, cylindrical tube is merely by way of illustration. It also will be appreciated that the device 10 can be provided with various modifications that will be described subsequently, all of these modifications being included as part of the device 10.

Figure 1:
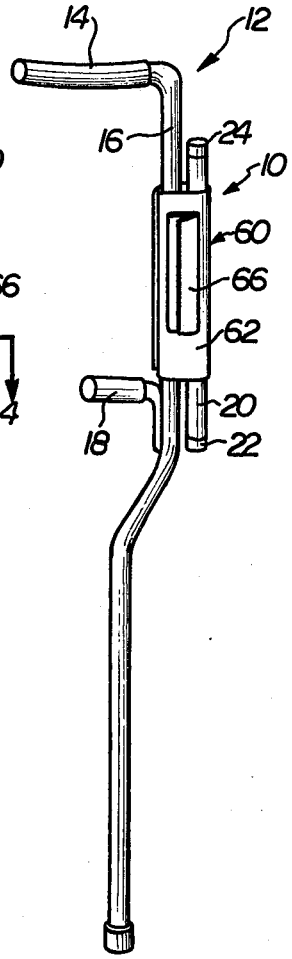
FIG. 1 is a perspective view of a crutch to which a carrying device according to the invention has been attached.
Figure 5:
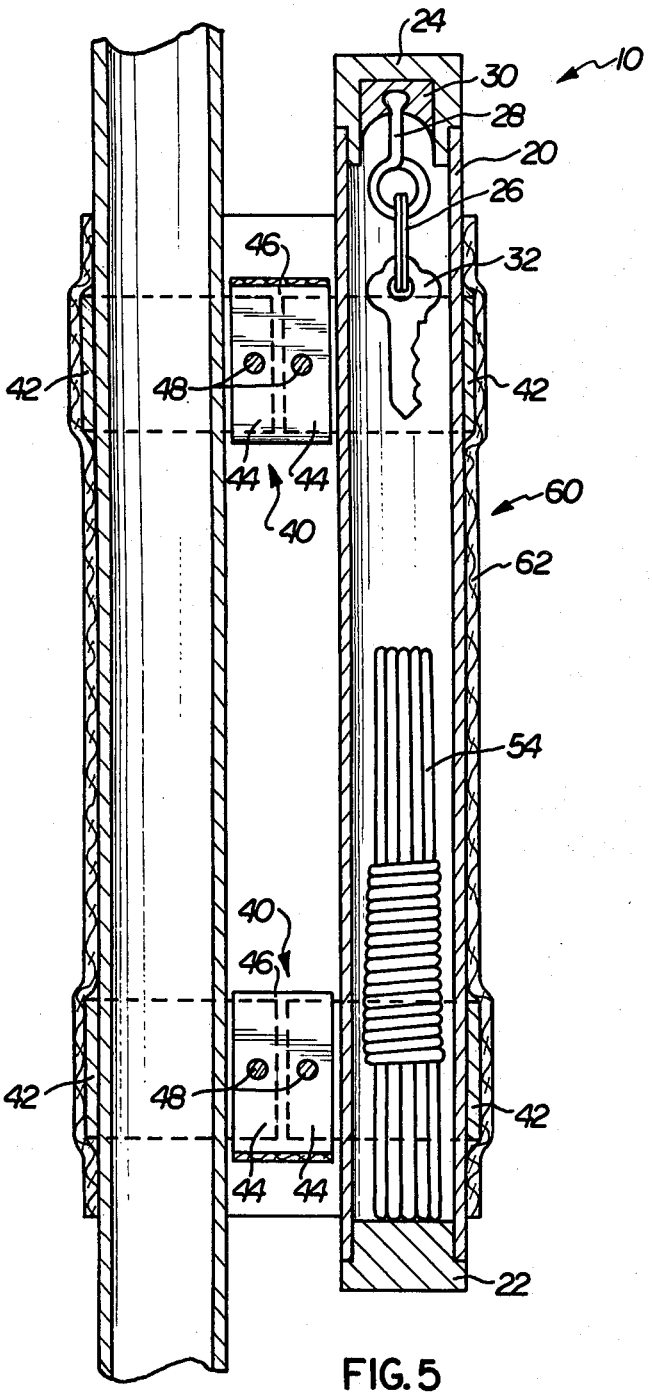
FIG. 5 is a cross-sectional view taken along line 5—5 of FIG. 3.

Referring to FIGS. 1 and 2, the device 10 is attached to a single-shaft aluminum crutch 12 having an arm support 14, a main support 16, and a hand grip 18. The device 10 includes a cylindrical, aluminum tube 20 approximately 1.25 inches in diameter and 12 inches long. The bottom of the tube 20 is closed by means of an end closure in the form of a stopper 22. The top of the tube 20 is fitted with another end closure in the form of a hollow rubber stopper 24 that fits snugly into the tube 20 and extends about 0.5 inch into the tube 20 so that the stopper 24 will remain securely in place although it can be removed for easy access to the interior of the tube 20. Referring particularly to FIG. 5, the stopper 24 also can be fitted with a key ring 26 secured within the interior of the stopper 24 by means of a post 28 and a base 30. The ring 26 is secured to the post 28, and is split as is well known so that one or more keys 32 may be attached to the ring 26. The ring 26, the post 28, and the keys 32 are covered by a leather cover (not shown) that can be snapped shut over the keys 32 to hold them in place and prevent rattling. In the event a key ring 26 is not provided for the stopper 24, the configuration of the stopper 24 will be identical to that of the bottom stopper 22. This construction is shown in FIG. 6.

In order to attach the tube 20 to the crutch 12, a connection means in the form of a pair of clamps 40 is provided. Each clamp 40 includes a flexible band 42 fitted about the tube 20. The band 42 also includes spaced legs 44 extending substantially parallel with each other. In the embodiment illustrated, the crutch 12 to which the device 10 is attached is cylindrical in cross-section. Accordingly, the clamp 40 includes components for attachment to the crutch 12 substantially identical to the ring 42 and the legs 44. The legs 44 of the opposing clamp portions are fitted into channel-like sections 46. The channel-like sections 46 and the legs 44 include openings through which bolted fasteners 48 may be fitted. In order to assemble the clamps 40, it is necessary only that the portions 42 be fitted about the respective tube 20 and crutch 12, the legs 44 compressed, and the legs 44 inserted from opposite ends into the channels 46. Thereafter, the fasteners 48 can be used to secure the clamp 40 into a rigid assembly.

The lowermost clamp 40 preferably is attached to the tube 20 about four inches from the lower end of the tube 20. The other clamp 40 should be attached about one and one-half inches from the top of the tube 20. The lowermost clamp 40 should be attached to the main support 16 a short distance above the handgrip 18. This particular mounting configuration has been found to be very effective in enabling heavy objects to be carried, while minimizing instability.

Figure 6:
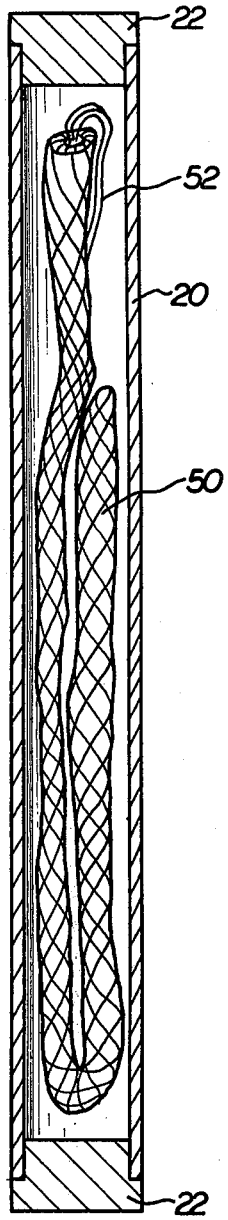
FIG. 6 is a cross-sectional view of a second tube employed with the invention, the tube containing a net for carrying objects.

Referring particularly to FIGS. 5 and 6, the tube 20 can be equipped with a nylon shopping net 50. The net 50 should be about 18 inches long, with a drawstring 52 at one end. The net 50 can be folded and pushed inside the tube 20 where it always will be available. The net 50 can be withdrawn easily for use by removing the stopper 22, 24 as the case may be, and extending a finger inside the tube 20. The net 50 can be used for carrying a number of small items by slipping the drawstring 52 over the upper end of the tube 20. The net 50 is ideal for use in shopping, in carrying books, and in carrying numerous other objects.

The other tube 20 can be equipped with a nylon rope 54 about two yards long having a noose in one end. The rope 54 can be used for heavy loads such as fireplace logs, bulky books, and so forth. Regardless of whether the net 50 or the rope 54 is used, the drawstring 52 or one end of the rope 54 can be secured to the tube 20 so that the crutch 12 itself bears the weight of whatever is being carried without putting an extra burden on the user of the crutches. Carrying of objects also is facilitated by attaching the tubes 20 to the front side of the crutches, that is, on that side of the crutches in the direction that the user is walking.

The device 10 includes a flexible casing 60. Casings 60 of slightly different configurations can be fitted about different devices 10 and the crutches 12 to which they are attached. The casing 60 as shown in the FIGURES includes a single, rectangular piece of leather 62 approximately 11 inches by 8.5 inches. A releasable fastener employing interlocking loops and hooks such as that sold under the trademark VELCRO can be attached to the opposed ends of the rectangular piece 62. Accordingly, the casing 60 can be wrapped about the tube 20 and the main support 16, folded upon itself, and secured in place.

Figure 3:
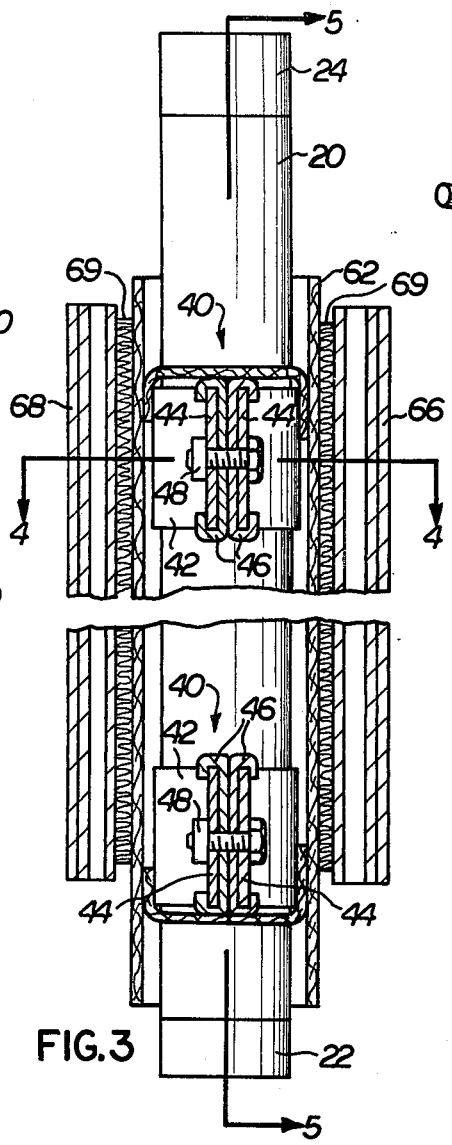
FIG. 3 is a cross-sectional view of the invention taken along the line 3—3 in FIG. 2.
Figure 4:
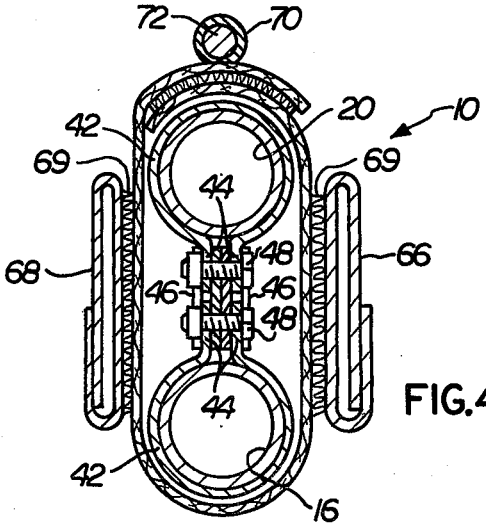
FIG. 4 is a cross-sectional view of the invention taken along the line of 4—4 in FIG. 3.

The casing 60 is equipped with various receptacles for carrying small, commonly carried objects. Referring particularly to FIG. 2, a first case 66 is sewn to the side of the casing 60. The other side of the casing 60 is provided with a second case 68. The second case 68 also is sewn to the casing 60. Referring to FIGS. 3 and 4, an alternative attachment technique for the cases 66, 68 is to attach them to the casing 60 by means of VELCRO fasteners 69. The first case 66 is large enough to contain a small, standard-sized address book. The second case 68 is provided with compartments for carrying credit cards, an extra notebook and the like. It will be appreciated that the casing 60 is quite versatile, in part because the entire casing 60 can be removed for various purposes. A third case 70 also is attached to the casing 60, although it is expected that the third case 70 will be non-removable. A pencil 72 or a similar object can be secured within the case 70.

In addition to the cases 66, 68, 70, the casing 60 also can be provided with yet an additional case (not shown) substantially similar in shape to that of the cases 66, 68, but larger. The larger case is intended to carry a checkbook. Yet additional versatility is provided by securing a pouch (not shown) to one side of the casing. The pouch should be flexible enough to accommodate larger objects such as a pouch of tobacco and/or a pipe. The pouch should be sufficiently flexible that objects of various configurations can be carried.

From the foregoing description, it will be apparent that the device 10 according to the invention is exceedingly light in weight, and yet it will enable a user of crutches to carry a wide variety of objects, including bulky objects, small objects, heavy objects, and other difficult-to-carry objects. The device 10 can be attached to virtually any type of crutch, regardless of the size or shape of the crutch components. The device 10 can be attached to the crutch with little difficulty, and yet an exceedingly strong connection will result.

Although the invention has been described in the preferred embodiment with a certain degree of particularity, it will be understood that the present disclosure of the preferred embodiment has been made only by way of example and that various modifications may be made without departing from the true spirit and scope of the invention as hereinafter claimed. Accordingly, it is intended that the patent shall cover, by suitable expression in the appended claims, whatever degree of patentable novelty exists in the invention disclosed.

What is claimed is:

1. A device for attachment to crutches to enable the user of the crutches to carry large objects, bulky objects, and other difficult-to-carry objects, the device comprising:

(a) an elongate aluminum tube, the tube having a circular cross-section, the tube being about 12 inches long and 1.25 inches in diameter;

(b) end closures for the tube, at least one of the closures being removable and in the form of a rubber stopper, the rubber stopper also carrying a post to which a key ring is secured, the key ring enabling keys to be carried within the tube;

(c) connecting means for attaching the tube to the crutch, the connecting means enabling the tube to be rigidly secured a pre-determined distance from the crutch and generally parallel with an elongate main crutch support, the connecting means including a first band encircling the tube, the first band including generally parallel legs, a second band encircling the crutch, the second band including generally parallel legs, channel shaped members into which the legs of the first and second bands can be inserted, the channel shaped members and the legs including openings through which bolted fasteners can be inserted and tightened, thereby attaching the tube rigidly to the crutch without modification of either the tube or the crutch;

(d) a flexible casing disposed about the tube and the crutch, the casing being releasably secured in place about the tube and the crutch by means of an interlocking hook and loop fastener, the casing also including the plurality of receptacles for receiving objects such as checkbooks, address books, pencils, and the like, the receptacles being attached to the outer portion of the casing; and (e) a rope and a net having a drawstring being disposed within the tube, the net and the rope being attachable to the tube so that large, bulky objects can be carried.

* * * * *